US006811130B1

(12) United States Patent
Oh

(10) Patent No.: US 6,811,130 B1
(45) Date of Patent: Nov. 2, 2004

(54) MOUNTING STRUCTURE FOR SPRINKLERS

(75) Inventor: Seung-il Oh, Seoul (KR)

(73) Assignee: Kofulso Co., Ltd., Incheon-si (KR)

( * ) Notice: Subject to any disclaimer, the term of this patent is extended or adjusted under 35 U.S.C. 154(b) by 0 days.

(21) Appl. No.: 10/731,865

(22) Filed: Dec. 10, 2003

(51) Int. Cl.[7] ..... E04B 9/10; F16L 3/08

(52) U.S. Cl. ..... 248/343; 248/62; 248/65; 248/75; 52/506.07; 52/715

(58) Field of Search ..... 248/62, 65, 75, 248/343; 52/220.6, 506.02, 506.07, 715

(56) References Cited

U.S. PATENT DOCUMENTS

| | | | | |
|---|---|---|---|---|
| 2,375,513 A | | 5/1945 | Bach | 248/59 |
| 3,341,909 A | | 9/1967 | Havener | 24/486 |
| 3,556,452 A | | 1/1971 | Ramsey | 248/228.5 |
| 3,558,091 A | | 1/1971 | Bush | 248/317 |
| 3,597,889 A | * | 8/1971 | Lo Nigro | 52/28 |
| 3,608,857 A | | 9/1971 | Hibbeler | 248/317 |
| 3,612,461 A | | 10/1971 | Brown | 248/317 |
| 3,652,780 A | | 3/1972 | Wilson | 174/45 R |
| 3,874,035 A | | 4/1975 | Schuplin | 248/72 |
| 4,041,657 A | * | 8/1977 | Schuplin | 52/39 |
| 4,135,692 A | | 1/1979 | Ferguson | 248/544 |
| 4,408,428 A | | 10/1983 | Brooke et al. | 52/506.07 |
| 4,544,119 A | | 10/1985 | Kellett et al. | 248/58 |
| 4,717,099 A | | 1/1988 | Hubbard | 248/57 |
| 4,723,749 A | | 2/1988 | Carraro et al. | 248/317 |
| 5,595,363 A | | 1/1997 | De Leebeeck | 248/72 |
| 5,667,181 A | | 9/1997 | Van Leeuwen et al. | 248/343 |
| 6,260,810 B1 | | 7/2001 | Choi | 248/65 |
| 6,341,466 B1 | * | 1/2002 | Kehoe et al. | 52/712 |
| 6,345,800 B1 | | 2/2002 | Herst et al. | 248/342 |
| 6,554,231 B2 | * | 4/2003 | Choi | 248/65 |

FOREIGN PATENT DOCUMENTS

| | | | |
|---|---|---|---|
| JP | 408038641 A | * | 2/1965 |
| JP | 407096050 A | * | 4/1995 |

OTHER PUBLICATIONS

U.S. Patent Application Publication No. US 2003/0029983 A1, Inventor: Pfaller, Published: Feb. 13, 2003.*

* cited by examiner

*Primary Examiner*—Anita King
*Assistant Examiner*—Jon Szumny
(74) *Attorney, Agent, or Firm*—Jacobson Holman PLLC

(57) ABSTRACT

A mounting apparatus for sprinklers which has a simple but firm mounting structure in which a fixing bracket couples a sprinkler reducer to a reducer support beam, and a pair of vertical brackets mount the reducer support beam to a pair of ceiling support rails. The mounting apparatus for sprinklers includes the pair of vertical brackets respectively mounted at lower ends thereof to upper ends of the pair of ceiling support rails, and the fixing bracket mounted to a predetermined portion of the reducer support beam between the pair of ceiling support rails, so as to vertically hold a sprinkler reducer which has a sprinkler head at an end thereof. In the mounting apparatus, the fixing bracket includes a rear part, first and second side parts, first and second curved parts, first and second tightening parts, first and second notches, first and second bolt holes, and a wing bolt. Each of the vertical brackets includes front and rear guide projections, third and fourth bolt holes, a guide hole, a guide rod, a leaning part, fifth and sixth bolt holes, a coupling bolt, first and second mounting holes, first and second hook-type locking grooves, and a locking unit.

3 Claims, 5 Drawing Sheets

MOUNTING STRUCTURE FOR SPRINKLERS

BACKGROUND OF THE INVENTION

1. Field of the Invention

The present invention relates generally to mounting apparatuses for sprinklers, and more particularly to a mounting apparatus for sprinklers which has a simple but firm mounting structure in which a fixing bracket couples a sprinkler reducer to a reducer support beam, and a pair of vertical brackets mount the reducer support beam to a pair of ceiling support rails.

2. Description of the Related Art

As well known to those skilled in the art, a plurality of ceiling support rails horizontally extend in parallel on the ceiling in a building to form a ceiling support structure, with a ceiling panel being mounted to the bottoms of the ceiling support rails so as to form a desired ceiling. A plurality of reducer support beams are mounted on the ceiling support rails by a plurality of mounting apparatuses so as to hold reducers of a sprinkler system in the ceiling.

Such a conventional mounting apparatus for sprinklers includes a pair of ceiling support rails horizontally extending in parallel to the ceiling in the building, with a predetermined gap defined between the pair of ceiling support rails. The conventional mounting apparatus further includes a pair of vertical brackets which are respectively mounted at lower ends thereof to upper ends of the pair of ceiling support rails. The conventional mounting apparatus further includes a reducer support beam which is horizontally held on upper ends of the pair of vertical brackets to be perpendicular to the ceiling support rails, and a fixing bracket provided at a predetermined position of the reducer support beam between the pair of ceiling support rails, so as to vertically hold a sprinkler reducer which has a sprinkler head at an end thereof. However, when the fixing bracket couples the sprinkler reducer to the reducer support beam and the pair of vertical brackets mount the reducer support beam to the pair of ceiling support rails, the conventional mounting apparatus must use a plurality of bolts as a fastening means.

Due to the above-mentioned construction using the plurality of bolts as the fastening means, the conventional mounting apparatus for sprinklers is problematic in that assembling and disassembling processes thereof are complex, thus reducing work efficiency while installing or removing the sprinklers in or from the ceiling.

SUMMARY OF THE INVENTION

Accordingly, the present invention has been made keeping in mind the above problems occurring in the prior art, and an object of the present invention is to provide a mounting apparatus for sprinklers which has a simple but firm mounting structure in which a fixing bracket couples a sprinkler reducer to a reducer support beam, and a pair of vertical brackets mount the reducer support beam to a pair of ceiling support rails.

In order to accomplish the above object, the present invention provides a mounting apparatus for sprinklers, including a pair of ceiling support rails horizontally extending in parallel to the ceiling in a building, with a predetermined gap defined between the pair of ceiling support rails; a pair of vertical brackets respectively mounted at lower ends thereof to upper ends of the pair of ceiling support rails; a reducer support beam horizontally held on upper ends of the pair of vertical brackets to be perpendicular to the ceiling support rails; and a fixing bracket mounted to a predetermined portion of the reducer support beam between the pair of ceiling support rails, so as to vertically hold a sprinkler reducer which has a sprinkler head at an end thereof, wherein the fixing bracket is formed by bending a metal plate having a predetermined width and length, and each of the vertical brackets is made of a metal plate having a predetermined width and length, and comprises first and second vertical sidewalls integrated together into a U-shaped single structure by a top wall. The fixing bracket includes a rear part; first and second side parts extending from both side edges of the rear part, respectively, so that the first and second side parts are perpendicular to the rear part; first and second curved parts extending from ends of the first and second side parts, respectively, while being bent inward to form a rounded shape; first and second tightening parts extending from ends of the first and second curved parts, respectively, so that the first and second tightening parts are parallel to each other; first and second notches respectively formed on predetermined portions of the first and second side parts such that the first and second notches are aligned with each other and internal edges of the first and second notches are in contact with an external surface of the reducer support beam, when the fixing bracket is fitted over the reducer support beam at the first and second notches; first and second bolt holes formed on the first and second tightening parts, respectively, such that the first and second bolt holes are aligned with each other; and a wing bolt tightened to the first and second bolt holes. Each of the vertical brackets includes front and rear guide projections extending upward from front and rear ends of the top wall, respectively; third and fourth bolt holes formed at predetermined positions on upper portions of the first and second vertical sidewalls, respectively, so as to be aligned with each other; a leaning part formed by inward bending a lower end of one of the first and second vertical sidewalls; fifth and sixth bolt holes axially formed on a lower end of a remaining one of the first and second vertical sidewalls and the leaning part, respectively, so as to be aligned with other; a coupling bolt tightened into an internal thread of the fifth bolt hole, so as to couple each of the vertical brackets to an associated ceiling support rail; first and second mounting holes formed on rear parts of the upper portions of the first and second vertical sidewalls, respectively, so as to be aligned with each other; first and second hook-type locking grooves formed on predetermined positions of front edges of the first and second vertical sidewalls, respectively; and a locking unit formed by bending a wire having predetermined diameter and strength. The locking unit has at an intermediate portion thereof a locking part so as to be removably locked to the hook-type locking grooves, with first and second ends of the locking unit being rotatably held in the first and second mounting holes so that the locking unit rotates around the first and second mounting holes, thus being locked to the hook-type locking grooves at the locking part thereof.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
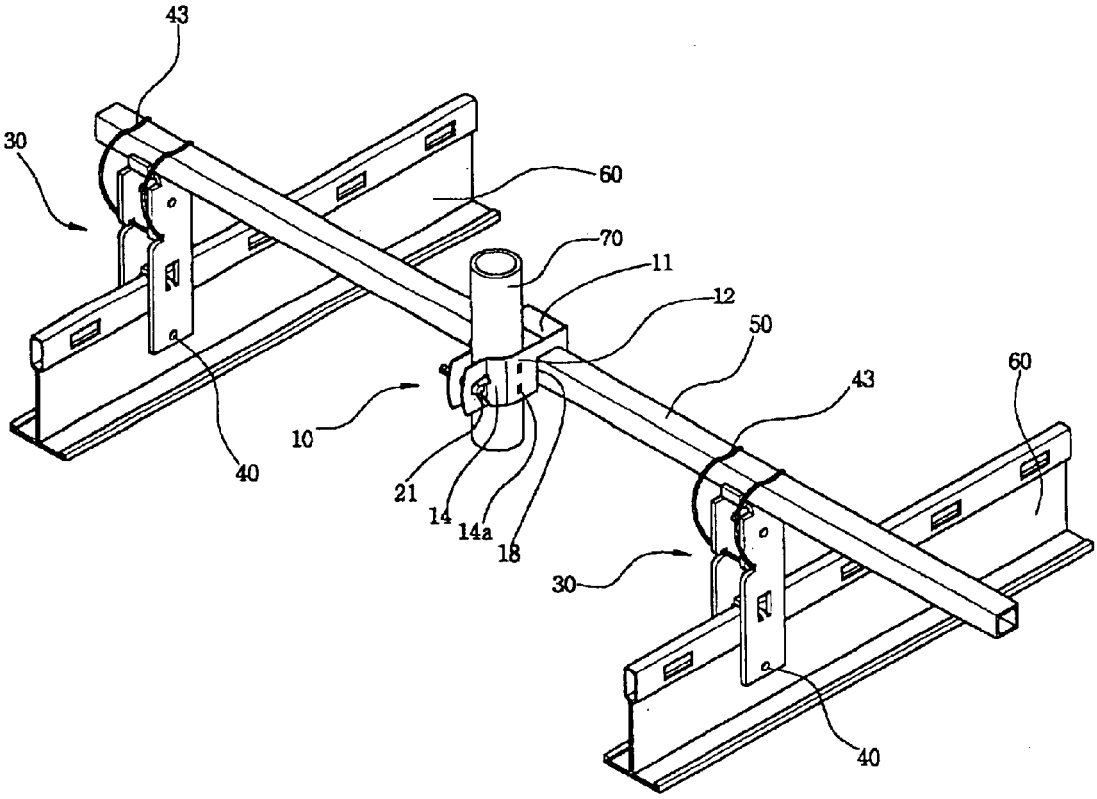
FIG. 1 is a perspective view of a mounting apparatus for sprinklers according to an embodiment of the present invention which is attached to a pair of ceiling support rails.

Hereinafter, embodiments of the present invention will be described in detail with reference to the attached drawings.

Reference now should be made to the drawings, in which the same reference numerals are used throughout the different drawings to designate the same or similar components.

Figure 2:
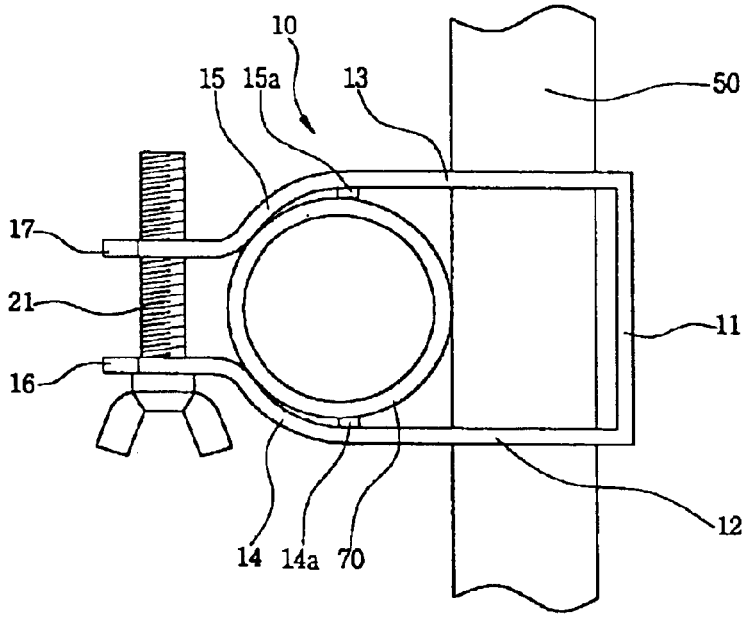
FIG. 2 is a top view of a fixing bracket of the mounting apparatus of FIG. 1, which couples a sprinkler reducer to a reducer support beam.
Figure 3:
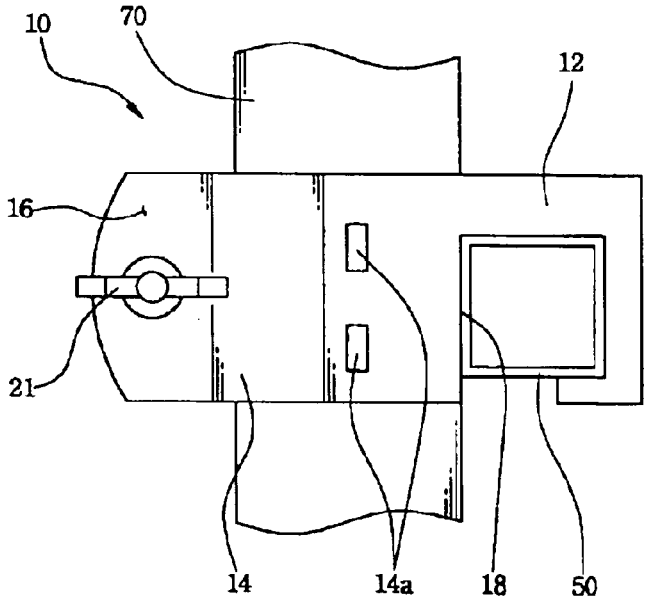
FIG. 3 is a side view of the fixing bracket of FIG. 2, which couples the sprinkler reducer to the reducer support beam.
Figure 4:
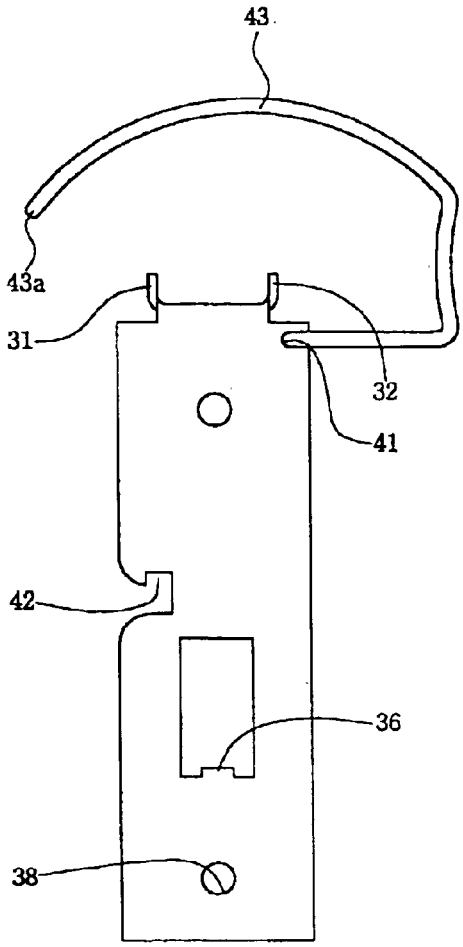
FIG. 4 is a side view of a vertical bracket of the mounting apparatus of FIG. 1, in which the vertical bracket is open at an upper end thereof.
Figure 5:
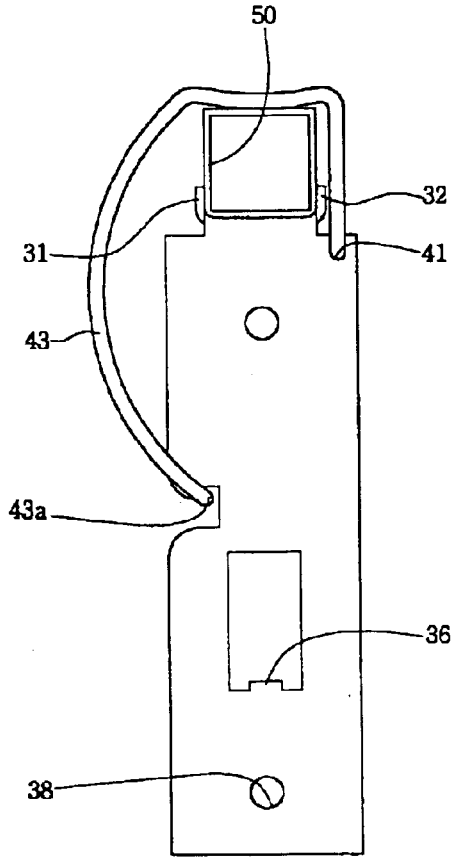
FIG. 5 is a side view of the vertical bracket of FIG. 4, in which the vertical bracket is coupled to the reducer support beam while a locking unit of the vertical bracket is locked to a hook-type locking grooves at a locking part thereof.
Figure 6:
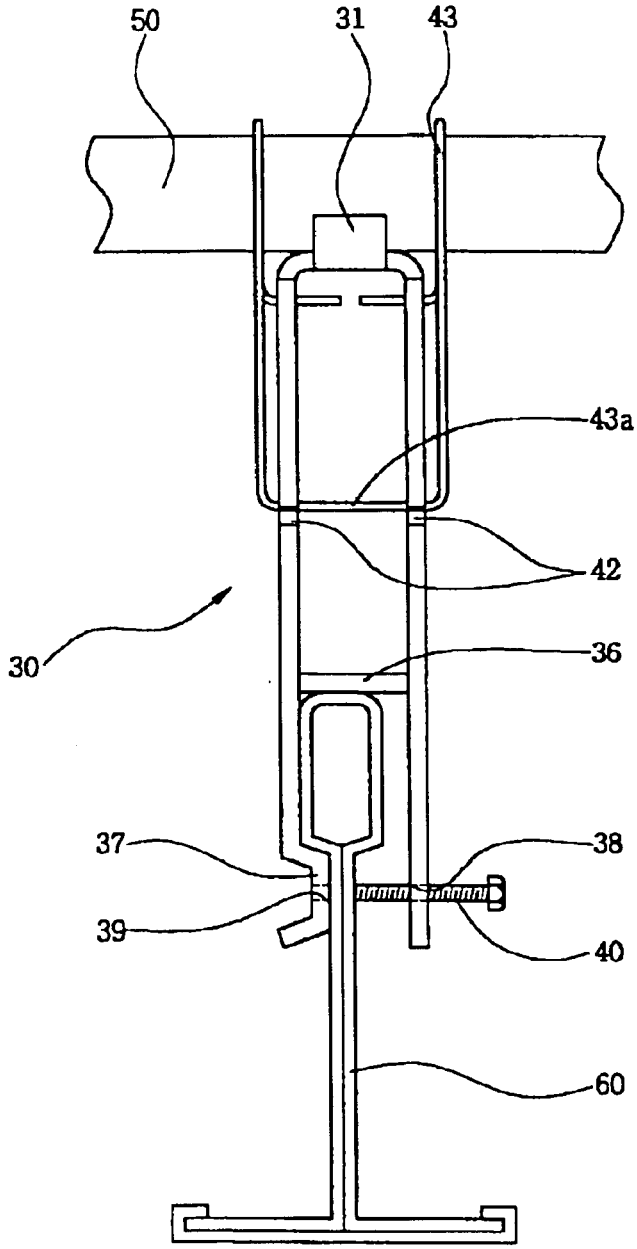
FIG. 6 is a front view of the mounting apparatus of FIG. 1, in which the vertical bracket mounts the reducer support beam to a ceiling support rail.
Figure 7:
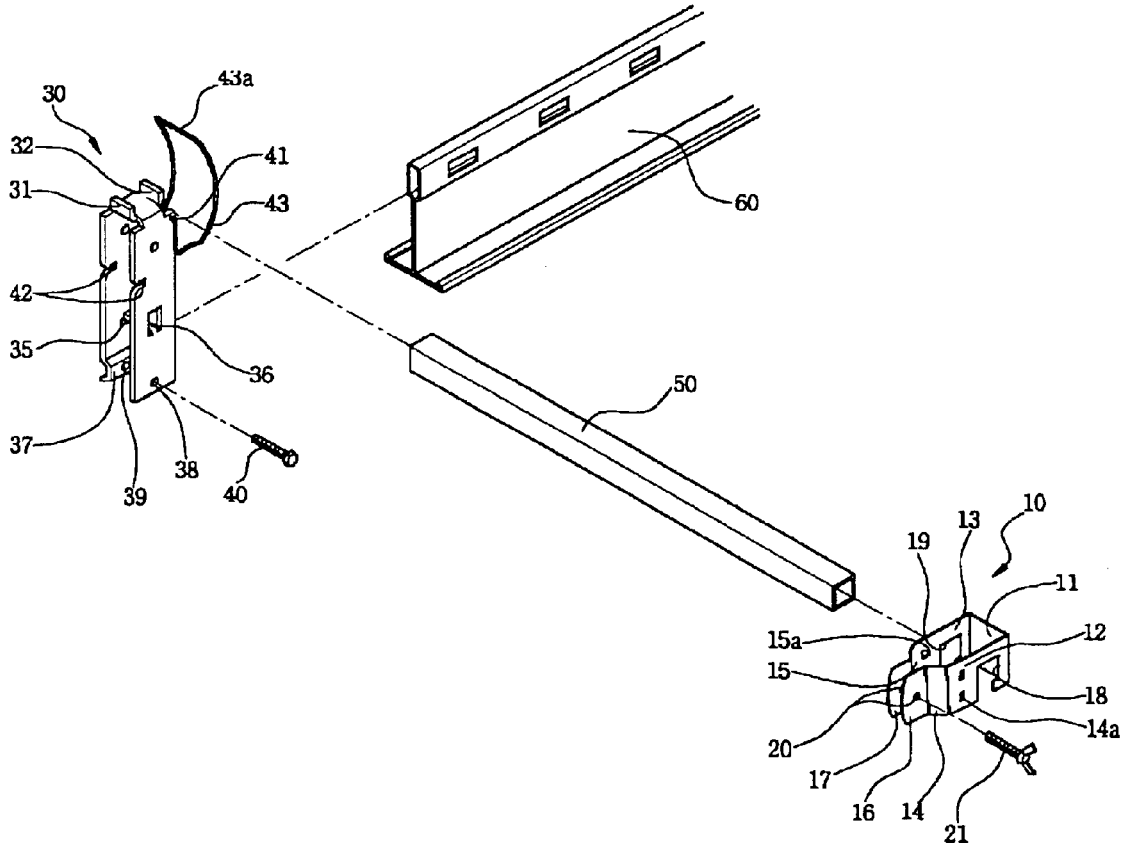
FIG. 7 is an exploded perspective view of the mounting apparatus of FIG. 1.

FIG. 1 is a perspective view of a mounting apparatus for sprinklers according to an embodiment of the present invention which is attached to a pair of ceiling support rails. FIG. 2 is a top view of a fixing bracket 10 of the mounting apparatus of FIG. 1, which couples a sprinkler reducer 70 to a reducer support beam 50. FIG. 3 is a side view of the fixing bracket 10 of FIG. 2, which couples the sprinkler reducer 70 to the reducer support beam 50. FIG. 4 is a side view of a vertical bracket 30 of the mounting apparatus of FIG. 1, in which the vertical bracket 30 is open at an upper end thereof. FIG. 5 is a side view of the vertical bracket 30 of FIG. 4, in which the vertical bracket 30 is coupled to the reducer support beam 50 while a locking unit 43 of the vertical bracket 30 is locked to a hook-type locking grooves 42 at a locking part 43*a* thereof. FIG. 6 is a front view of the mounting apparatus of FIG. 1, in which the vertical bracket 30 mounts the reducer support beam 50 to a ceiling support rail 60. FIG. 7 is an exploded perspective view of the mounting apparatus of FIG. 1.

As shown in FIGS. 1 to 7, the mounting apparatus for sprinklers of the present invention includes the fixing bracket 10 by which the sprinkler reducer 70 is coupled to the reducer support beam 50. The mounting apparatus further includes the pair of vertical brackets 30 by which the reducer support beam 50 is supported on the pair of ceiling support rails 60.

The fixing bracket 10 is formed by bending a metal plate having a predetermined width and length. The fixing bracket 10 includes a rear part 11, first and second side parts 12 and 13, first and second curved parts 14 and 15, first and second tightening parts 16 and 17, first and second notches 18 and 19, first and second bolt holes 20 and a wing bolt 21.

The first and second side parts 12 and 13 extend from both side edges of the rear part 11, respectively, so that the first and second side parts 12 and 13 are perpendicular to the rear part 11. The first and second curved parts 14 and 15 extend from ends of the first and second side parts 12 and 13, respectively, while being bent inward to form a rounded shape. The first and second tightening parts 16 and 17 extend from ends of the first and second curved parts 14 and 15, respectively, so that the first and second tightening parts 16 and 17 are parallel to each other.

A plurality of anti-slip projections 14*a* and 15*a* are projected on internal surfaces of both the first and second curved parts 14 and 15 to prevent the sprinkler reducer 70 from moving in a space defined between the first and second curved parts 14 and 15 and the reducer support beam 50.

The first and second notches 18 and 19 are respectively formed on predetermined portions of the first and second side parts 12 and 13 such that the first and second notches 18 and 19 are aligned with each other and internal edges of the first and second notches 18 and 19 are in contact with an external surface of the reducer support beam 50, when the fixing bracket 10 is fitted over the reducer support beam 50 at the first and second notches 18 and 19. The first and second bolt holes 20 are formed on the first and second tightening parts 16 and 17, respectively, such that the first and second bolt holes 20 are aligned with each other. A wing bolt 21 is tightened to the first and second bolt holes 20.

Each of the vertical brackets 30 is made of a metal plate having a predetermined width and length, and comprising first and second vertical sidewalls integrated together into a U-shaped single structure by a top wall. Each of the vertical brackets 30 includes front and rear guide projections 31 and 32, third and fourth bolt holes, a guide hole 35, a guide rod 36, a leaning part 37, fifth and sixth bolt holes 38 and 39, a coupling bolt 40, first and second mounting holes 41, first and second hook-type locking grooves 42, and a locking unit 43.

The front and rear guide projections 31 and 32 extend upward from front and rear ends of the top wall of the vertical bracket 30, respectively. The third and fourth bolt holes are formed at predetermined positions on upper portions of the first and second vertical sidewalls of the vertical bracket 30, respectively, so as to be aligned with each other. The guide hole 35 is formed on a predetermined position of the second vertical sidewall of the vertical bracket 30.

The guide rod 36 is projected inward from a lower edge of an opening which is formed on a predetermined position of the first vertical sidewall of the vertical bracket 30 corresponding to the guide hole 35, so that the guide rod 36 is inserted into the guide hole 35 to move relative to the guide hole 35.

The leaning part 37 is formed by inward bending a lower end of the second vertical sidewall of the vertical bracket 30. The fifth and sixth bolt holes 38 and 39 are axially formed on a lower end of the first vertical sidewall of the vertical bracket 30 and the leaning part 37, respectively, so as to be aligned with other. The coupling bolt 40 is tightened into an internal thread of the fifth bolt hole 38, so as to couple each of the vertical brackets 30 to an associated ceiling support rail 60. The first and second mounting holes 41 are formed on rear parts of the upper portions of the first and second vertical sidewalls of the vertical bracket 30, respectively, so as to be aligned with each other. The first and second hook-type locking grooves 42 are formed on predetermined positions of front edges of the first and second vertical sidewalls of the vertical bracket 30, respectively.

The locking unit 43 is formed by specifically bending a wire having predetermined diameter and strength. The locking unit 43 has at an intermediate portion thereof a locking part 43*a* so as to be removably locked to the hook-type locking grooves 42, with first and second ends of the locking unit 43 being rotatably held in the first and second mounting holes 41 so that the locking unit 43 rotates around the first and second mounting holes 41, thus being locked to the hook-type locking grooves 42 at the locking part 43*a* thereof.

Next, the operation and effect of the mounting apparatus of the present invention will be described herein below.

The wing bolt 21 of the fixing bracket 10 is loosened from the first and second bolt holes 20 to relax the first and second curved parts 14 and 15 of the fixing bracket 10. Thereafter, the fixing bracket 10 is fitted over the reducer support beam 50 at the first and second notches 18 and 19 thereof. The sprinkler reducer 70 is thereafter inserted into the space defined between the first and second curved parts 14 and 15 and the reducer support beam 50, thus the sprinkler reducer 70 is placed at a predetermined position. The wing bolt 21 is thereafter tightened into first and second bolt holes 20, so that an external surface of the sprinkler reducer 70 is in tight contact with both the internal surfaces of the curved parts 14 and 15 and the external surface of the reducer support beam 50, thus the sprinkler reducer 70 is forcibly supported. Therefore, the fixing bracket 10 firmly couples the sprinkler reducer 70 to the reducer support beam 50.

In the meantime, the pair of vertical brackets 30 are respectively placed at the lower ends thereof on the upper ends of the pair of ceiling support rails 60, such that the leaning part 37 of the second sidewall of each of the pair of vertical brackets 30 is leaned on a sidewall of each of the pair of ceiling support rails 60. Thereafter, the coupling bolt 40 is tightened into the fifth bolt hole 38 of the first sidewall of each of the pair of vertical brackets 30, so that the pair of vertical brackets 30 are firmly coupled to the pair of ceiling support rails 60, respectively. Thereafter, the locking units 43 of the pair of vertical brackets 30 are rearward rotated to open the upper ends of the pair of vertical brackets 30, respectively, and the reducer support beam 50 is placed between the first and second guide projections 31 and 32 on the upper ends of the pair of vertical brackets 30. The locking units 43 are, thereafter, frontward rotated until the locking parts 43*a* of the locking units 43 are respectively locked to the hook-type locking grooves 42 of the pair of vertical brackets 30 while the reducer support beam 50 is placed on the upper ends of the pair of vertical brackets 30, thus firmly mounting the reducer support beam 50 to the ceiling support rails 60.

As described above, the present invention provides a mounting apparatus for sprinklers which has a simple but firm mounting structure in which a fixing bracket couples a sprinkler reducer to a reducer support beam, and a pair of vertical brackets mount the reducer support beam to a pair of ceiling support rails.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A mounting apparatus for sprinklers, comprising: a pair of ceiling support rails horizontally extending in parallel to the ceiling in a building, with a predetermined gap defined between the pair of ceiling support rails; a pair of vertical brackets respectively mounted at lower ends thereof to upper ends of the pair of ceiling support rails; a reducer support beam horizontally held on upper ends of the pair of vertical brackets to be perpendicular to the ceiling support rails; and a fixing bracket mounted to a predetermined portion of the reducer support beam between the pair of ceiling support rails, so as to vertically hold a sprinkler reducer which has a sprinkler head at an end thereof, wherein the fixing bracket is formed by bending a metal plate having a predetermined width and length, the fixing bracket comprising:

a rear part;

first and second side parts extending from both side edges of the rear part, respectively, so that the first and second side parts are perpendicular to the rear part;

first and second curved parts extending from ends of the first and second side parts, respectively, while being bent inward to form a rounded shape;

first and second tightening parts extending from ends of the first and second curved parts, respectively, so that the first and second tightening parts are parallel to each other;

first and second notches respectively formed on predetermined portions of the first and second side parts such that the first and second notches are aligned with each other and internal edges of the first and second notches are in contact with an external surface of the reducer support beam, when the fixing bracket is fitted over the reducer support beam at the first and second notches;

first and second bolt holes formed on the first and second tightening parts, respectively, such that the first and second bolt holes are aligned with each other; and a wing bolt tightened to the first and second bolt holes, and each of the vertical brackets is made of a metal plate having a predetermined width and length, and comprises:

first and second vertical sidewalls integrated together into a U-shaped single structure by a top wall;

front and rear guide projections extending upward from front and rear ends of the top wall, respectively;

third and fourth bolt holes formed at predetermined positions on upper portions of the first and second vertical sidewalls, respectively, so as to be aligned with each other;

a leaning part formed by inwardly bending a lower end of one of the first and second vertical sidewalls;

fifth and sixth bolt holes axially formed on a lower end of a remaining one of the first and second vertical sidewalls and the leaning part, respectively, so as to be aligned with other;

a coupling bolt tightened into an internal thread of the fifth bolt hole, so as to couple each of the vertical brackets to an associated ceiling support rail;

first and second mounting holes formed on rear parts of the upper portions of the first and second vertical sidewalls, respectively, so as to be aligned with each other;

first and second hook-type locking grooves formed on predetermined positions of front edges of the first and second vertical sidewalls, respectively; and a locking unit formed by bending a wire having a predetermined diameter and strength, the locking unit having at an intermediate portion thereof a locking part so as to be removably locked to the hook-type locking grooves, with first and second ends of the locking unit being rotatably held in the first and second mounting holes so that the locking unit rotates around the first and second mounting holes, thus being locked to the hook-type locking grooves at the locking part thereof.

2. The mounting apparatus according to claim 1, wherein each of the vertical brackets further comprises:

a guide hole formed on a predetermined position of one of the first and second vertical sidewalls; and a guide rod projected inward from a lower edge of an opening which is formed on a predetermined position of a remaining one of the first and second vertical sidewalls corresponding to the guide hole, so that the guide rod is inserted into the guide hole to move relative to the guide hole.

3. The mounting apparatus according to claim 1, wherein the fixing bracket further comprises:

a plurality of anti-slip projections projected on internal surfaces of both the first and second curved parts to prevent the sprinkler reducer from moving in a space defined between the first and second curved parts and the reducer support beam.

* * * * *